US006179284B1

(12) United States Patent
Maertin et al.

(10) Patent No.: US 6,179,284 B1
(45) Date of Patent: Jan. 30, 2001

(54) METHOD AND APPARATUS FOR FORMING A SCALED FLOW OF OVERLAPPING SHIPMENTS

(75) Inventors: Uwe Maertin, Constance; Christoph Hofmann, Salem; Armin Zimmermann, Constance, all of (DE)

(73) Assignee: Siemens Aktiengesellschaft, Munich (DE)

( * ) Notice: Under 35 U.S.C. 154(b), the term of this patent shall be extended for 0 days.

(21) Appl. No.: 09/188,412

(22) Filed: Nov. 10, 1998

(30) Foreign Application Priority Data

Nov. 10, 1997 (DE) ..... 197 49 610

(51) Int. Cl.[7] ..... B65H 29/38; B65H 43/00
(52) U.S. Cl. ..... 271/177; 271/176
(58) Field of Search ..... 271/176, 199, 271/177, 207, 69

(56) References Cited

U.S. PATENT DOCUMENTS

| | | | | |
|---|---|---|---|---|
| 3,606,311 | * | 9/1971 | Yoshimura | 271/177 |
| 3,814,415 | | 6/1974 | Hunter et al. . | |
| 3,942,786 | * | 3/1976 | Lauren | 271/177 |
| 4,285,513 | * | 8/1981 | Kwasnitza | 271/199 |
| 4,657,241 | | 4/1987 | Frank . | |
| 4,776,578 | * | 10/1988 | Hirakawa et al. | 271/176 |
| 4,799,663 | * | 1/1989 | Golicz | 271/199 |
| 4,863,154 | * | 9/1989 | Hirakawa et al. | 271/176 |
| 5,171,008 | | 12/1992 | Zimmermann . | |
| 5,224,697 | | 7/1993 | Darchis et al. . | |

FOREIGN PATENT DOCUMENTS

| | | | |
|---|---|---|---|
| 3317865A1 | | 11/1984 | (DE) . |
| 3700827A1 | | 7/1988 | (DE) . |
| 37 23 259 | | 4/1995 | (DE) . |
| 0 565 254 | | 10/1993 | (EP) . |
| 2288049 | * | 5/1976 | (FR) ..... 271/177 |
| 63165266 | | 7/1988 | (JP) . |

* cited by examiner

*Primary Examiner*—Donald P. Walsh
*Assistant Examiner*—Daniel K. Schlak
(74) *Attorney, Agent, or Firm*—Venable; Norman N. Kunitz

(57) ABSTRACT

A method and a device form a scaled flow of overlapped articles from a flow of individual, flat and elastic articles, e.g. for stacking, without the following articles impacting with the rear edges of the preceding articles. In order to achieve a high flow rate, independent of the article length, the respectively preceding article remains during the overlapping in a locally fixed position until the supplied, respectively following article impacts from the side with the preceding article in accordance with the predetermined overlapping length. Following this, the two articles as well as all previous articles are jointly transported further until the rear edge of the now last, preceding article has reached the locally fixed position according to the predetermined overlapping length.

5 Claims, 3 Drawing Sheets

METHOD AND APPARATUS FOR FORMING A SCALED FLOW OF OVERLAPPING SHIPMENTS

BACKGROUND OF INVENTION

The invention relates to a method and a device for forming a scaled flow of overlapped flat articles, which are supplied and removed with their longitudinal sides positioned between side mounted guide means.

The overlapping of articles is advantageous, for example, for the space-saving transport of the articles in sorting machines or the secure stacking in stacking compartments where a following article is to be prevented from bumping into the rear edge of a preceding article.

A solution has become known (DE 37 23 259 C2), which provides in addition to the main conveying track a secondary conveying track with diverters to prevent a backing up of the articles during the stacking in. This arrangement calls for the overlapping of two successive articles.

Two variants are possible here:

1. A second article takes a shorter path as compared to a first article, as a result of which a varied degree of overlapping can be achieved when the articles converge, depending on the length of the article and the gap.
2. A second article is transported at a higher speed, relative to a first article. If the speed can be controlled, then a constant overlapping can be achieved when the articles converge.

However, a continuous scaled flow cannot be produced with this. An additional disadvantage is the relatively high expenditure. In the operational sequence sorter SLS for letters, manufactured by the company Elsag Bailey, Genoa, a continuous or a discontinuous flow of individual articles is taken over by a second conveying system. This system operates in the start-stop mode with constant intervals. In the course of this, the following article is deposited on the preceding article in such a way that the front edge of the articles is always stopped in the same position and subsequently, the resulting scale is moved forward by a constant distance. The resulting scaled flow thus has a constant spacing between the front edges of the articles.

In order to prevent bumping against the rear edges of the preceding articles during the overlapping, the articles must arrive at the second conveying system at a pointed angle, wherein the rear edges of the articles must leave the resulting entry triangle in a timely fashion.

Owing to the fact that articles with a varying format are to be processed, a correspondingly large gap must exist, oriented toward the long articles with their large, empty surfaces since the rear edges of the long articles leave the entry triangle only relatively slowly as a result of their inherent mass inertia and stiffness, thereby resulting in a low flow rate, or a correspondingly involved auxiliary device must be used to ensure that the rear edges clear the entry triangle quickly, e.g. a stacking spindle (DE-OS 33 17 865) or a contact pressure roller (DE-OS 37 00 827).

SUMMARY OF THE INVENTION

The invention pertains to a method and a device for forming a scaled flow of overlapped articles from a flow of individual, flat, elastic articles, which method and device permit a high flow rate with low apparatus expenditure. The invention pertains to a method and device for forming a scaled flow of overlapped, flat articles from a flow of individual, flat and elastic articles which are supplied and removed with longitudinal edges thereof positioned between side-mounted guide means, and includes feeding a preceding article in a feeding direction; holding the preceding article immovable at a clamping region in a removal direction at an angle to the feeding direction, and with a rear edge of the preceding article at a fixed distance from the clamping region, so a rear section of the proceeding article pivots from the being oriented in the feeding direction to being oriented in the removal direction; and feeding a following article in the feed direction to impact with the preceding article, wherein the following article does not reach the rear edge of the preceding article until the rear section of the preceding article has pivoted to being oriented in the removal direction. Both the preceding and following articles are fed together until the following article is held immovable as a respective preceding article in the holding step above.

An advantage of the invention is that independent of the length of the article, the overlapping length is always uniform, owing to the selection of the rear edges as reference value for the control.

The free rear section of the preceding article is selected short enough so that the entry triangle is formed as quickly as possible owing to the elasticity of the article, but that bumping into the rear edges of the preceding articles is avoided at the same time.

In an embodiment of the invention, the preceding article is set into motion with the scaled flow just before the following article arrives, so that at the point of impact, the articles move at the same speed. This prevents the articles from backing up. An embodiment which uses guide belts, is designed to be operationally safe and cost-saving.

An embodiment of the invention provides a light barrier for detecting the stop signal and the start signal for the driven deflection roller is arranged inside the guide means for feeding in order to avoid installation problems.

The invention is explained in further detail in the following with the aid of an exemplary embodiment and the drawings.

DETAILED DESCRIPTION OF THE PREFERRED EMBODIMENTS

Figure 1:
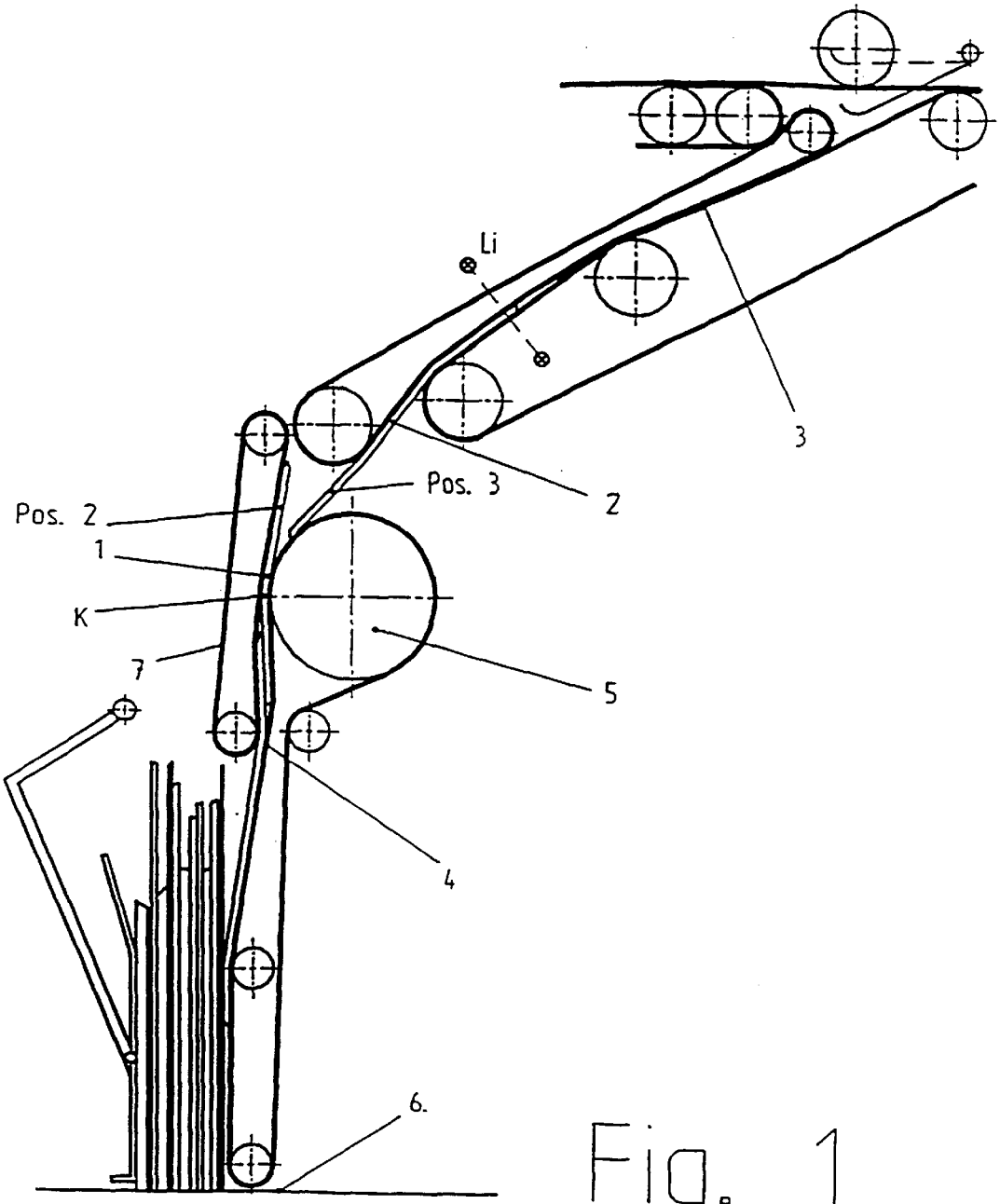
FIG. 1 shows a side view of a device for forming a scaled flow for a stacking compartment.
Figure 2:
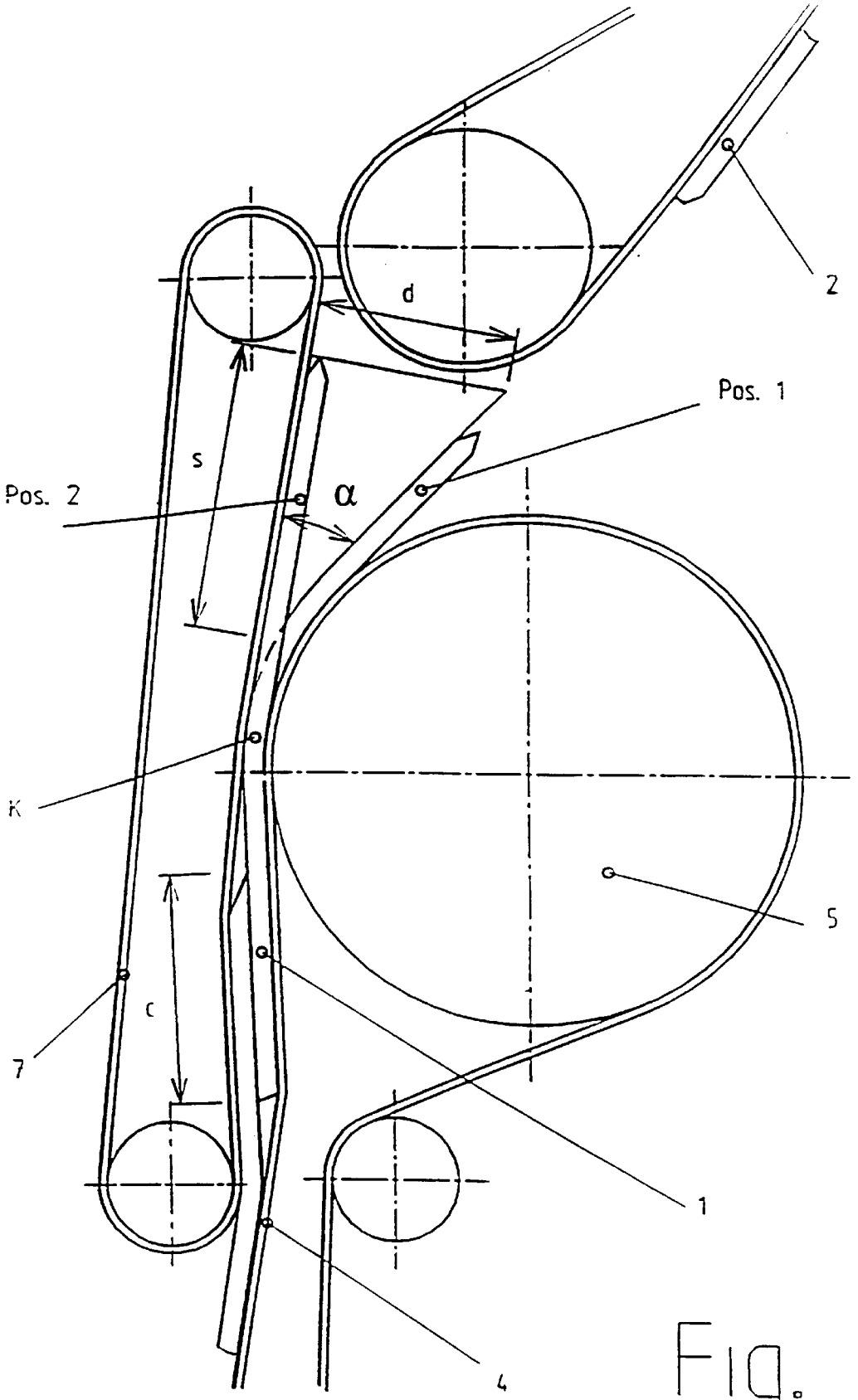
FIG. 2 shows a side view of the device with the drive region, at the point in time when it is stopped.
Figure 3:
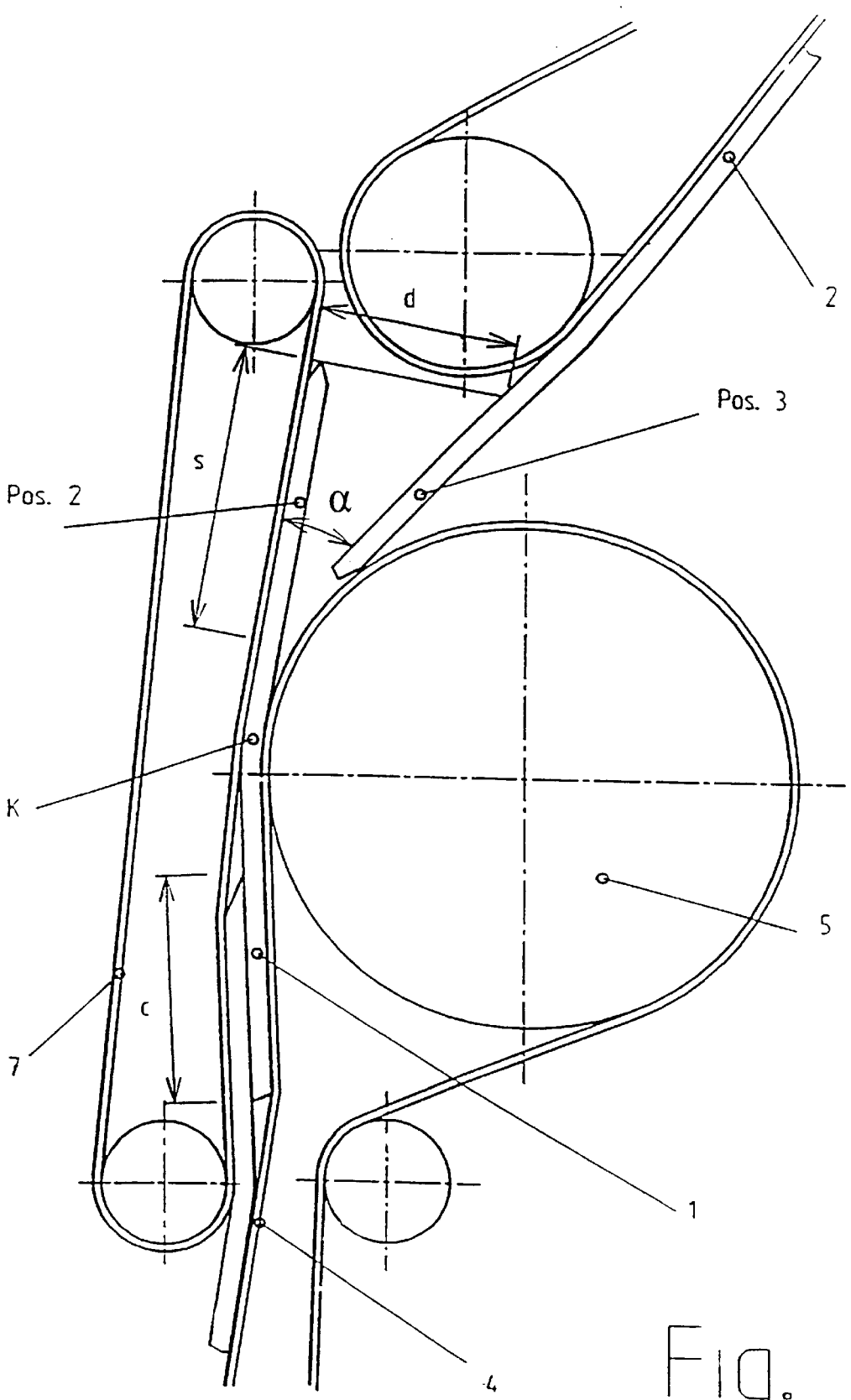
FIG. 3 shows a side view of the device with the drive region, at the time of entry for the following article.

A guide belt system functioning as feed means 3 and consisting of elastic guide belts that are guided over deflection rollers, guides the individually following articles 2 toward the device.

The device consists of a first guide belt 4, which transports the overlapped articles to an end stop 6. This guide belt 4 is operated in the start-stop mode via a deflection roller 5, on the side facing away from the stacking location. A second, endless guide belt 7 that is guided over two deflection rollers is located at the deflection roller 5 and is also directed toward the stacking location.

This second guide belt projects over the first guide belt, counter to the stacking movement, so as to support the rear section of the preceding article.

The rear edge of the article is respectively detected with a light barrier Li. When reaching the position 1, the article is stopped regardless of the article length. When in the position 1, the distance of the rear edge from the point of impact of the following article coincides with the specified overlap. The stop signal is derived from the light-barrier signal of the rear edge, whereas the start signal is derived from the light-barrier signal of the front edge by taking into account the transporting speed and the distance of light barrier Li. The deflection roller 5 thus is operated in the stop-start mode, causing the first belt 4 to be operated in the stop-start mode as well.

The last article 1 of the scaled flow is clamped in the clamping region around the point K. As a result of this, the free length s of article 1 which projects from the first guide belt 4 does not depend on the article length. If the first guide belt 4 is started via the deflection roller 5 at the moment of impact of the following article 2, then the free length s corresponds to the constant overlapping length c. However, the articles 1, 2 can back up during this process. In order to avoid this, the guide belt 4 is started shortly before the article 2 impacts, so that at the moment of impact, both articles 1, 2 have approximately the same speed. To ensure that the distance between impact point and rear edge corresponds at the moment of impact to the overlapping length c, the free length s for the resting article 1 must be longer by the necessary measure.

The inherent stiffness of the articles, even of very unstable articles, is sufficient so that after the rear edge of the article 1 leaves the feeding means 3, this rear edge jumps within a very short time from position 1 to position 2 where it rests against the guide band 7. As a result, the entry triangle is cleared quickly for the following article 2.

If the front edge of the following article 2 has reached the position 3, then the first guide belt 4 is started as described, so that it runs at rated speed when the following article 2 is taken over from the guide belt 4.

The angle $\alpha$ and the free length s define a right triangle (entry triangle), the cathetus d of which should not fall below a minimum measure to prevent the following article 2 from impacting with the preceding article 1, even if the edges are turned over, etc . . . The entry triangle must exist at the time when the following article 2 starts to move along the hypotenuse, that is to say when the rear edge of the preceding article 1 is in position 2 (not inside the entry triangle).

The preceding article 1 and the following article 2 are conveyed with a constant overlap c between the guide belts 4 and 7 until the guide band 4 stops, which is triggered by the rear edge of the following article 2.

As a result, a flow of articles with constant overlap c is produced, which moves in intervals toward the stop 6, thereby causing the articles to glide one on top of the other and form a stack. The geometry must be selected such that even the shortest article always remains clamped in and that the overlap cannot disappear.

Owing to the stop-start mode of guide belt 4 and thus also the non-driven second guide belt 7, the upright standing article remains for a very short time on the running elements, so that no damage can occur.

What is claimed is:

1. A method for forming a scaled flow of overlapped, flat articles from a flow of individual, flat and elastic articles, which are supplied and removed with their longitudinal edges positioned between side-mounted guide means, wherein the respectively first one of the individual articles impacts on the side with the respectively last article in the scaled flow under a pointed angle ($\alpha$) to the article segment behind the impact point and is then clamped in together with it, wherein the respectively preceding article remains immovable and at a fixed distance(s) between the article rear edge and the rear edge of the clamping region of the following article, until the supplied following article impacts with the preceding article, wherein the following article does not reach the rear edge of the preceding, immovable article until the rear section of this immovable article, which is free starting with the impact point, is pivoted from the feeding direction into the removal direction of the scaled flow and that subsequently these two articles, as well as all the previous articles, are transorted jointly and with guidance until the rear edge of the now last preceding article has reached the fixed distance(s) to the rear edge of the clamping region, wherein the preceding article, as well as all preceding articles, are put into motion just prior to the impact of the following article, in such a way that both articles have the same transporting speed at the time of impact.

2. A method for forming a scaled flow of overlapped, fat articles from a flow of individual, flat and elastic articles which are supplied and removed with longitudinal edges thereof positioned between side-mounted guide means, comprising the steps of:

feeding a preceding article in a feeding direction;

holding the preceding article immovable at a clamping region in a removal direction at an angle to the feeding direction, and with a rear edge of the preceding article at a fixed distance from the clamping region, so that a rear section of the proceeding article pivots from being oriented in the feeding direction to being oriented in the removal direction; and feeding a following article in the feed direction to impact with the preceding article, wherein the following article does not reach the rear edge of the preceding article until the rear section of the preceding article has pivoted to being oriented in the removal direction; and transporting both the preceding and following articles together until the following article is held immovable as a respective preceding article in the holding step above.

3. A method according to claim 2, wherein the preceding article is put into motion just prior to the impact of the following article so that both articles have the same transporting speed at the time of impact.

4. A device for forming a scaled flow of overlapped, flat articles from a flow of separate, flat and elastic articles, which are supplied and removed with longitudinal edges thereof positioned between side-mounted guide means, comprising:

a first elastic guide belt with a first guide surface that moves between first rollers for guiding the articles in a transporting direction;

a driven deflection roller operated in a start-stop mode for moving the first guide belt;

a second elastic guide belt having a second guide surface that moves between second deflection rollers with a segment of the second guide surface pushing against the first guide surface of the first guide belt, so that the articles are transported while clamped at a clamping region between the first and second guide belts, wherein the second guide belt surface has a rear surface that does not come in contact with the first guide belt; and a feeding device for feeding articles in a feeding direction at an angle to the transporting direction wherein a following article is fed in a feeding direction to impact a preceding article at a point of impact to the rear of the clamping region, at an angle to the rear end of the preceding article, wherein a distance between a rear end of the clamping region and the feeding means is at least as long as a shortest article to be fed, and is at least as long as a longest overlap length to be formed, wherein the driven deflection roller is activated so that the preceding article is moved in the transporting direction, and the driven deflection roller is stopped when a predetermined distance is reached between a point of impact between the rear and at the clamping region and the rear edge of the preceding article, wherein the distance between the rear end of the clamping region and the rear edge of the preceding article is selected so that the following article does not impact with the rear edge of the preceding article, even when the edges of the preceding articles are turned over, and wherein feeding device feeds the following article so that the following article does not reach the preceding, stopped article until a non-clamped portion of the preceding, stopped article pivots into the transporting direction and against the rear segment of the second guide belt, and wherein the rear segment of the second guide belt is long enough to support the rear edge of the preceding article.

5. A device according to claim 1, further comprising:

a light barrier arranged inside the feeding means;

means for generating a stop signal for the driven deflection roller to indicate a given preceding article has reached the predetermined distance between the rear end of the clamping region and the rear edge of the preceding article, based on: a distance from a light barrier to the point of impact at the rear end of the clamping region, the feeding speed, and a measuring signal of the light barrier when the rear edge of the preceding article passes the light barrier; and means for generating a start signal for the driven deflection roller based on a measuring signal from the light barrier when the front edge of following article following the preceding article passes the light barrier.

* * * * *